US006457280B1

(12) United States Patent
Park

(10) Patent No.: US 6,457,280 B1
(45) Date of Patent: Oct. 1, 2002

(54) ROTARY BUNGALOW COMPRISING A CABIN, ROTARY SHAFT AND SUPPORT UNIT, WATER PIPE, WATER PUMP, AND WATER TANK INSTALLED UNDER THE CABIN

(75) Inventor: Byoung-ki Park, Sungnam (KR)

(73) Assignee: Il-Hong Enterprise Co., Ltd., Seoul (KR)

( * ) Notice: Subject to any disclaimer, the term of this patent is extended or adjusted under 35 U.S.C. 154(b) by 0 days.

(21) Appl. No.: 09/804,140

(22) Filed: Mar. 13, 2001

(51) Int. Cl.[7] ..... E04B 1/346

(52) U.S. Cl. ..... 52/65; 52/73

(58) Field of Search ..... 52/65, 64, 73

(56) References Cited

U.S. PATENT DOCUMENTS 3,599,378 A * 8/1971 Kachnic ..... 52/127.1
3,905,166 A * 9/1975 Kaiser ..... 52/65

* cited by examiner

*Primary Examiner*—Carl D. Friedman
*Assistant Examiner*—Naoko Slack
(74) *Attorney, Agent, or Firm*—Larson & Taylor PLC

(57) ABSTRACT

Disclosed is a rotary bungalow, comprising a cabin forming an inner space therein; a hollow rotary shaft extended downward from the cabin; a support unit rotatably supporting the rotary shaft; a water tank installed under the cabin; a water pipe extended between the water tank and the cabin through the rotary shaft; and a water pump drawing in the water within the water tank through the water pipe to the cabin. With this configuration, the user is allowed to use the rotary bungalow conveniently and pleasantly.

6 Claims, 5 Drawing Sheets

ROTARY BUNGALOW COMPRISING A CABIN, ROTARY SHAFT AND SUPPORT UNIT, WATER PIPE, WATER PUMP, AND WATER TANK INSTALLED UNDER THE CABIN

BACKGROUND OF THE INVENTION

1. Field of the Invention

The present invention relates to a rotary bungalow.

2. Description of the Related Art

Typically, a bungalow is used in a recreation center at rivers, mountains, beaches, etc. to provide travelers, mountaineers, etc. with a space for rest or camping, etc. A rotary bungalow is rotatable in response to a user's desire, considering a view, an amount of sunshine or the direction of the wind, etc. at the area to be located.

Referring to FIG. 5 which is a sectional view of a conventional rotary bungalow, the conventional rotary bungalow 101 is comprised of a cabin 110 provided with an indoor space therein, a support unit 120 supporting the cabin 110 so as to be spaced from the ground to a predetermined height, and a rotary unit 150 rotating the cabin 110.

The cabin 110 is comprised of a rectangular plate member 111 forming a bottom thereof, a plurality of wall members 112 uprightly disposed on sides of the plate member 111, forming an indoor space thereof, and a ceiling member 113 disposed on the top of the wall members 112, covering the indoor space. The wall member 112 of the cabin 110 is provided with a door 118 and a window 117. Under the door 118 is mounted a ladder 119 allowing the user to come in and out.

The support unit 120 is comprised of a pillar-shaped support column 121 uprightly installed on the ground and a support base 123 buried in the ground, supporting a lower end of the support column 121. The rotary unit 150 is comprised of a fixed table 151 coupled to an upper end of the support column 121, and a rotatable table 153 installed on the central lower surface of the cabin 110, rotating relative to the fixed table 151.

The fixed table 151 is comprised of a circular lower plate 161 fixed to the top end of the support column 121, having a hole 164 formed in the center thereof, and a plurality of rollers 163 installed in the periphery of the lower plate 161, rotatably supporting the rotatable table 153. In a portion of the lower plate 161 is provided a fixed pin 165 allowing the rotatable table 153 to be rotated or fixed.

The rotatable table 153 is comprised of a circular upper plate 171 coupled to a central region of the plate member 111 of the cabin 110, a flange 173 extended downward from the edge of the upper plate 171, for accommodating the fixed table 151 therein, and a central shaft 174 protruding downward from the central lower region of the upper plate 171 to be rotatably coupled to the central hole 164 of the fixed table 151.

With this configuration, the rotatable table 153 installed on the plate member 111 of the cabin 110 is rotatably placed on the rollers 163 of the fixed table 151, thereby rotating the cabin 110.

However, the conventional rotary bungalow is not provided with water supply facilities for supplying water into the cabin, for which the user is not allowed for cooking and washing, etc. within the cabin. In addition, since the conventional rotary bungalow is not provided with a draining unit for draining water and sewage to be generated from cooking, washing and easing nature, etc., it is in fact impossible to cook, wash and go to stool, etc. within the cabin. As a consequence, the user has to endure with inconvenience, that is, to use a common kitchenette, a common washroom and a common laboratory, etc.

SUMMARY OF THE INVENTION

Accordingly, the present invention has been made keeping in mind the above-described problem, and an object of the present invention is to provide a rotary bungalow having water supply facilities supplying water into a cabin.

Another object of the present invention is to provide a rotary bungalow having a draining unit draining water and sewage generated within the cabin.

These and other objects of the present invention may be accomplished by a provision of a rotary bungalow comprising a cabin provided with an indoor space therein; a hollow rotary shaft extended downward from the cabin; a support unit rotatably supporting the rotary shaft; a water tank installed under the cabin; a water pipe extended between the-water tank from the cabin through the rotary shaft; and a water pump pumping the water within the water tank through the water pipe to the cabin.

Preferably, the water tank is buried in the ground.

Desirably, the water pump is installed within the cabin, and the water pipe and the water pump are rotated when the cabin is rotated.

It is also preferable that the rotary bungalow further comprises a draining pipe extended downward from the cabin so as to discharge sanitary and sewage water from the cabin, being rotated along with the cabin; and a water collector provided in the support unit, storing the sanitary and sewage water from the draining pipe.

Preferably, the water collector includes a discharge pipe discharging the stored sanitary and sewage water in the water collector.

Effectively, the water collector is comprised of the first storage and the second storage disposed concentrically so as to store the sanitary water and the sewage water respectively.

BRIEF DESCRIPTION OF THE DRAWINGS

The present invention will be better understood and its various objects and advantages will be more fully appreciated from the following description taken in conjunction with the accompanying drawings, in which.

DETAILED DESCRIPTION OF THE PREFERRED EMBODIMENTS

Figure 1:
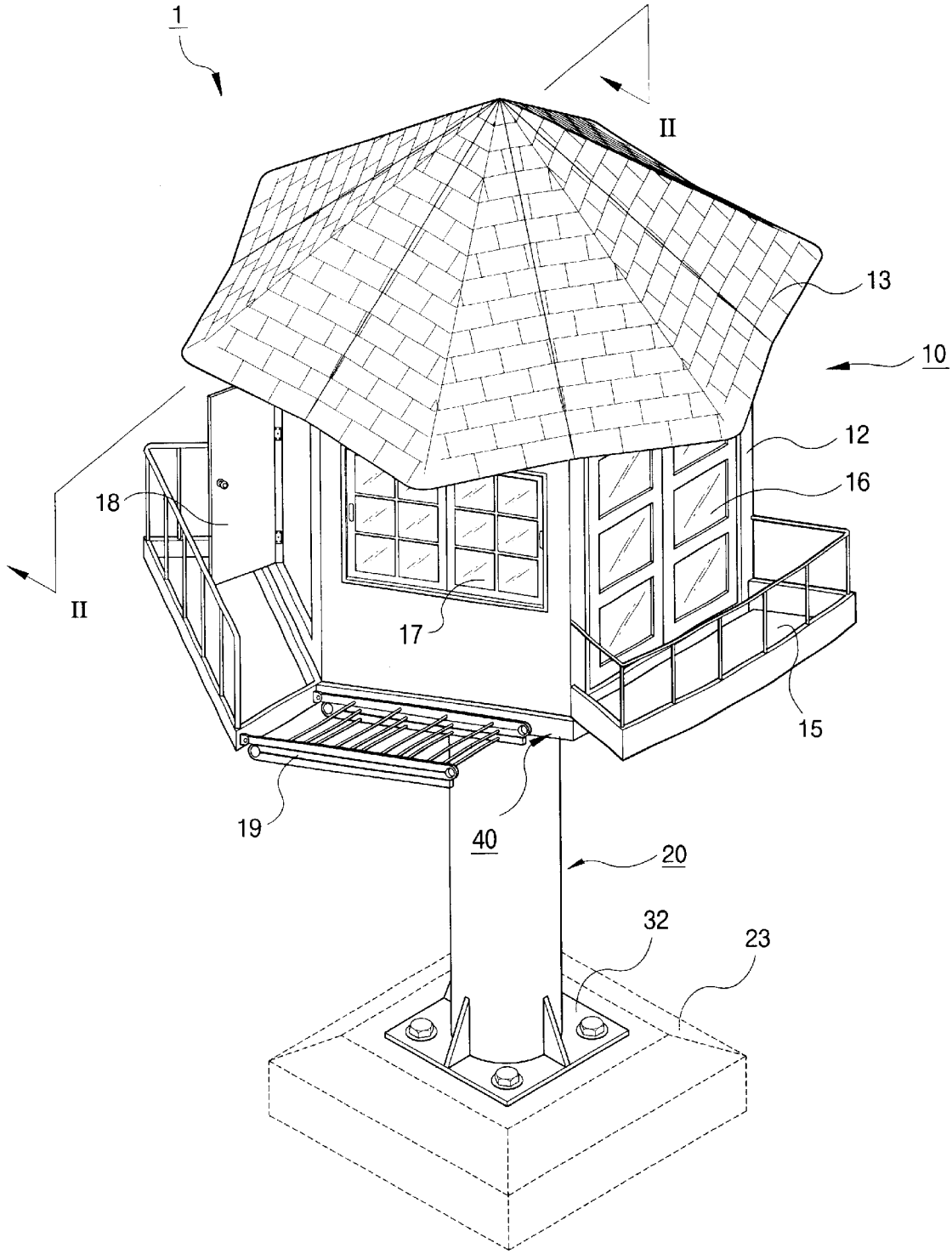
FIG. 1 is a perspective view of a rotary bungalow according to the present invention.
Figure 2:
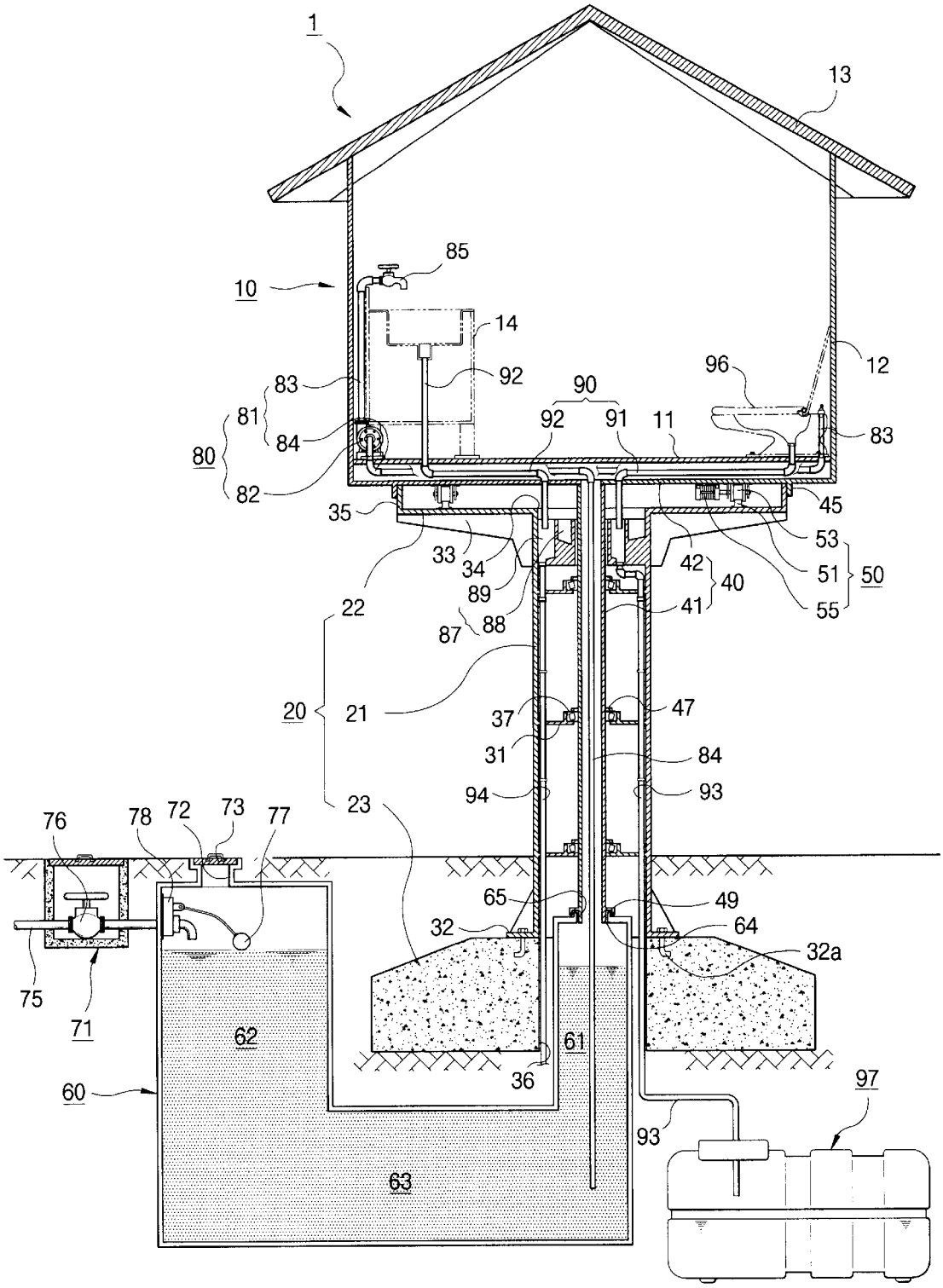
FIG. 2 a sectional view taken along line II—II of FIG. 1.

Referring to FIGS. 1 through 4, a rotary bungalow 1 according to the present invention is comprised of a cabin 10 provided with an indoor space therein, a support unit 20 supporting the cabin 10 so as to be spaced from the ground to a predetermined distance, a rotary unit 40 coupled to the lower part of the cabin 10 and rotatably supported by the support unit 20, a driving unit 50 rotating the rotary unit 40, a water tank 60 installed under the cabin 10, a water supply unit 80 supplying water stored in the water tank 60 into the cabin 10, and a draining unit 86 draining out the sewage generated within the cabin 10.

The cabin 10 is comprised of a polygonal lower plate 11 forming an indoor bottom thereof, a plurality of wall members 12 uprightly disposed on the respective sides of the lower plate 11, forming an indoor space, and a ceiling member 18 disposed so as to cover a top opening of the wall face members 12.

The lower plate 11, the wall members 12 and the ceiling member 13 constituting the cabin 10 by assemblage are made of polyurethane foaming material, or synthetic resin or wooden panel internally formed with other insulating materials. Within the cabin 10 are provided a small sink unit 14 for cooking, a toilet 96, a washstand (not shown) and a small bed for rest (not shown), etc. for the sake of convenience for the users. Outside the cabin 10 are separately installed a small warehouse (not shown) and a balcony 15, etc. The water supply unit 80 supplies water to the sink unit 14, the toilet 96 and the washstand (not shown) provided inside the cabin 10 from the outside.

One wall member 12 is provided with a door 18 to allow the user to come in and out, and the other wall face members 12 are provided with either a window for ventilation 17 of an indoor air and a balcony window 16, etc. A ladder 19 is elevatably mounted outside the door 18 to allow the user to come in and out of the cabin 10.

The support unit 20 is comprised of a hollow support column 21 uprightly mounted on the ground, a circular fixed table 22 provided in the upper end of the support column 21, rotatably supporting the lower part of the cabin 10, and a support base 23 buried under the ground, to be coupled to the lower end of the support column 21.

The support column 21 is made of a tubular pipe member. On the upper end of the support column 21 are disposed a plurality of support ribs 33 with the same interval along the circumference thereof, for supporting the lower part of the fixed table 22. On the lower end of the support column 21 is formed a support flange 32 coupled to the support base 23 by a plurality of anchor bolts 32*a*. A plurality of bearing seats vertically spaced from each other are formed inside the support column 21, and a roller bearing 37 rotatably supporting a rotary shaft 41 of the rotary unit 40 to be described later is installed in each bearing seat 31.

In the central portion of the fixed table 22 is formed a shaft passing hole 34 communicating with the inside of the support column 21. On the edge of the fixed table 22 is provided a wall 35 extended upward to a predetermined height along the circumference thereof.

The support base 23 is substantially in the shape of rectangular parallelepiped of concrete, and it has such volume as to prevent the support column 21 from being moved by a weight of the cabin 10. In the central portion of the support base 23 is formed a passing hole 36 communicating with the inside of the support column 21.

The rotary unit 40 is comprised of a rotary table 42 rotatably installed on the top of the fixed table 22 of the support column 21, supporting the lower part of the cabin 10, and a hollow rotary shaft 41 extended downward from the central portion of the rotary table 42.

Figure 3:
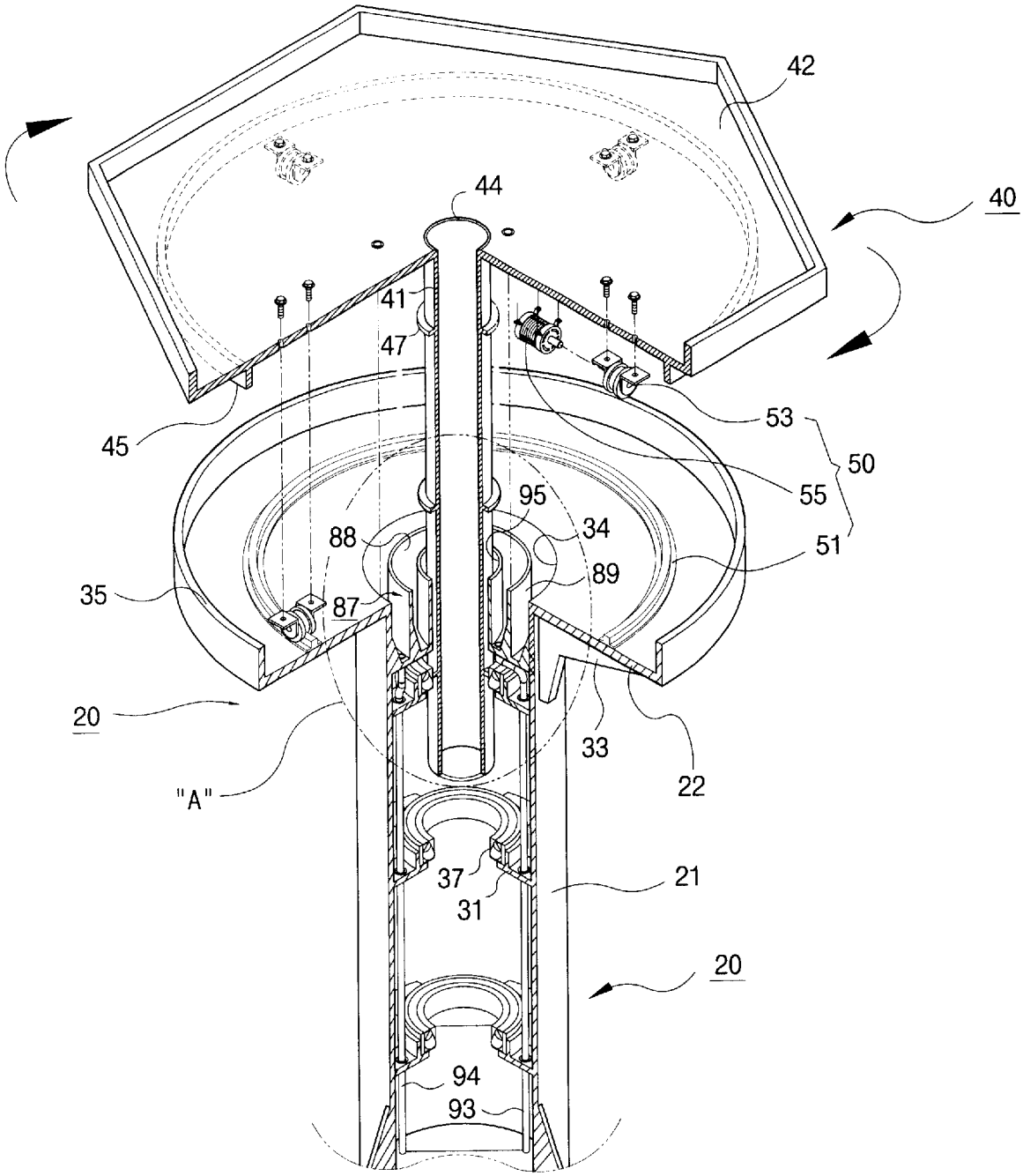
FIG. 3 an exploded perspective view of a support unit and a rotary unit of FIG. 1.
Figure 4:
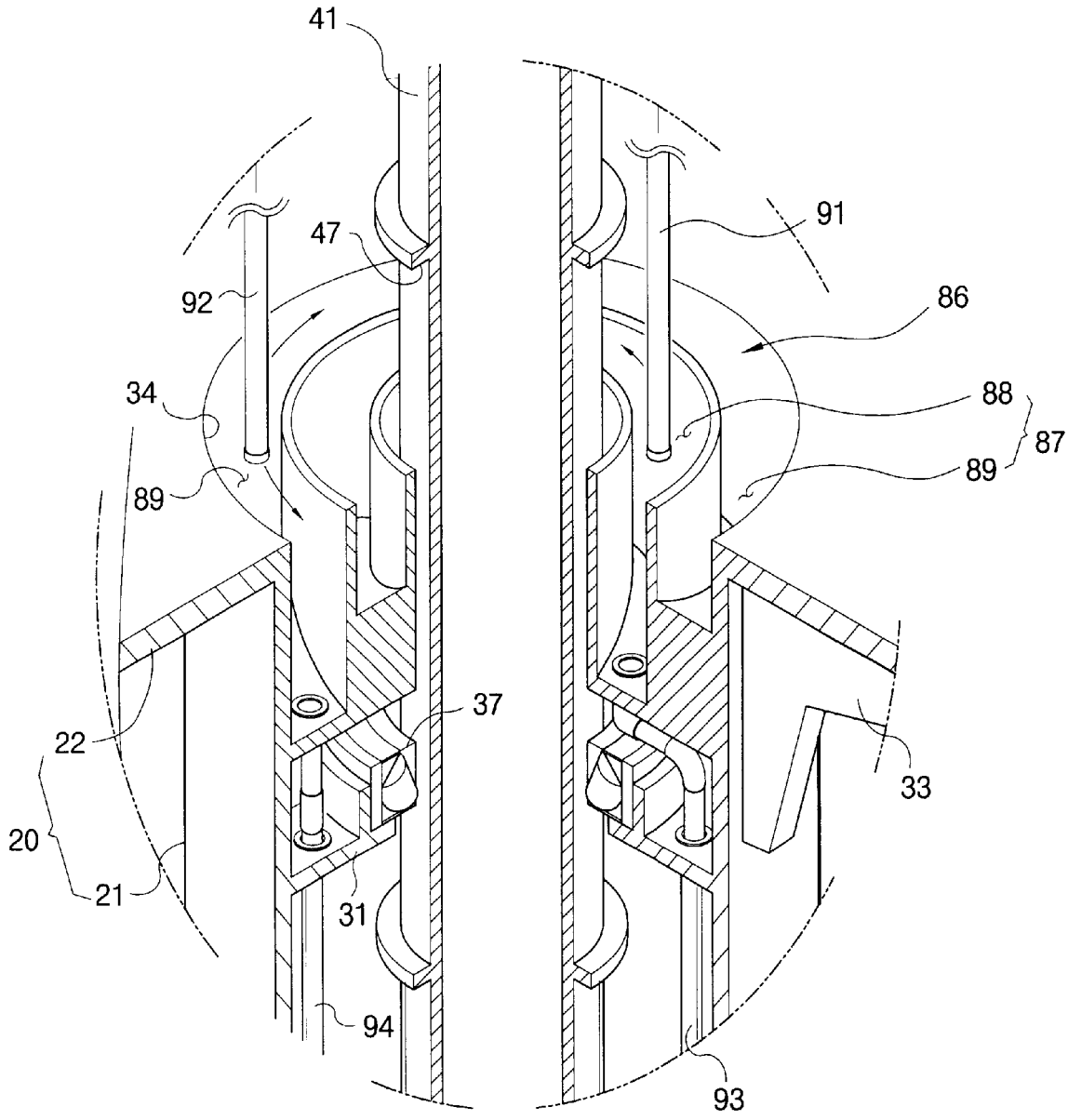
FIG. 4 is an enlarged perspective view of "A" of FIG. 3.
Figure 5:
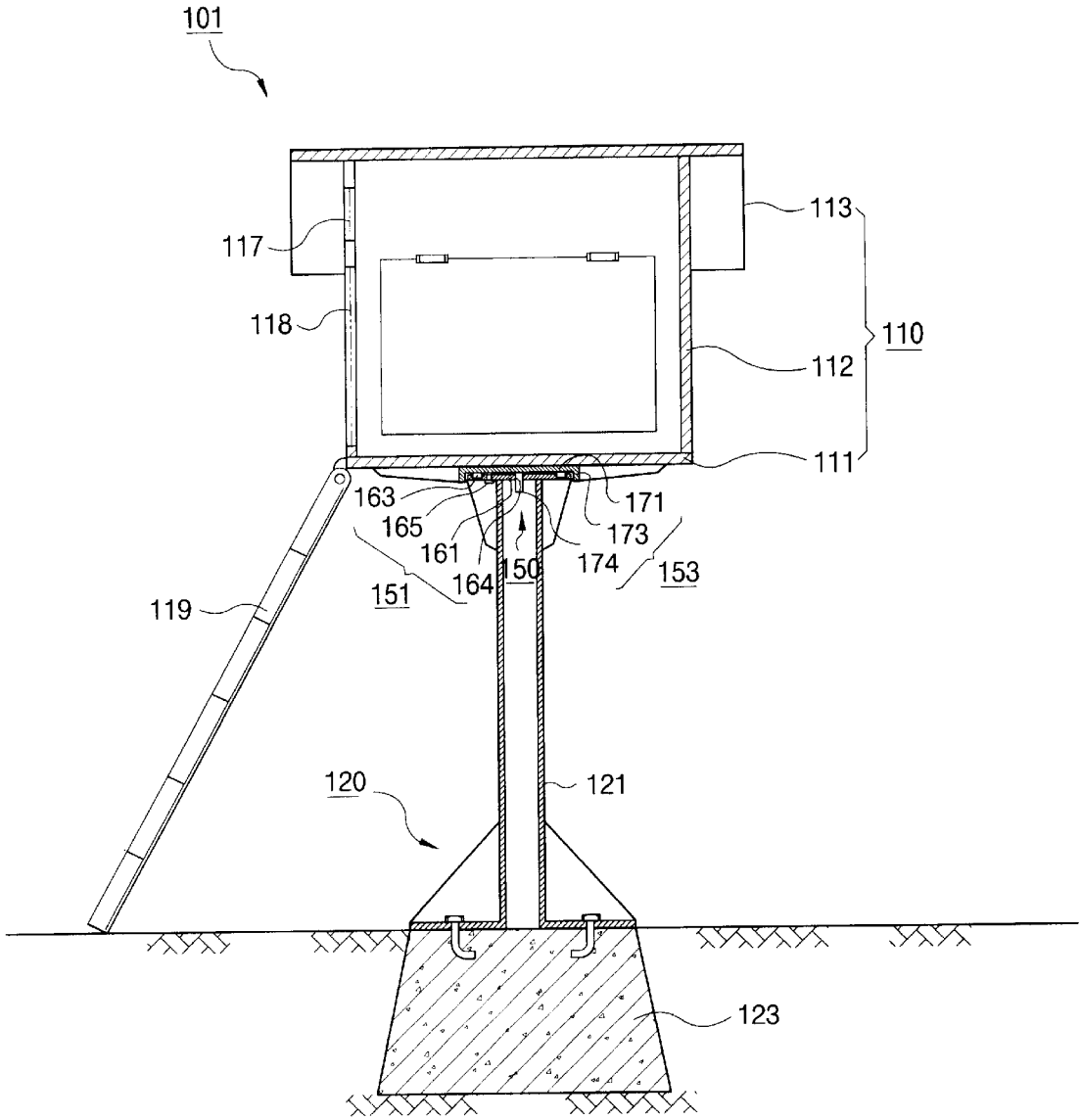
FIG. 5 (PRIOR ART)
FIG. 5 is a section view of a conventional rotary bungalow.

The rotary table 42 has a polygonal plane corresponding to the lower plate 11 of the cabin 10, supporting a lower circumference of the cabin 10 so as to be spaced from the lower plate 11 of the cabin 10 to a predetermined distance. As shown in FIG. 3, in the central portion of the rotary table 42 is formed a pipe passing hole 44 communicating with the inside of the rotary shaft 41; in the lower surface of the rotary table 42 is formed a surrounding wall 45 protruding downward so as to surround the wall 35 of the fixed table 22 described above.

The rotary shaft 41 is made of a tubular pipe having a smaller inner diameter than that of the support column 21 of the support unit 20, and is concentrically accommodated inside the support column 21 through the shaft passing hole 34 of the support unit 20. A plurality of journals 47 are formed on an outer circumferential surface of the rotary shaft 41, the journals 47 being rotatably supported by the roller bearing 37 installed inside the support column 21. On the lower end of the rotary shaft 41 is provided a bent flange 49 (FIG. 2) extended radially, so as to surround an extension 65 formed along the edge of a water pipe passing hole 64 of the water tank 60 to be described later.

The driving means 50 is comprised of a rail 51 installed on the top face of the fixed table 22 of the support unit 20, a plurality of rollers 53 installed on the bottom face of the rotary table 42 of the rotary unit 40, traveling along the rail 51, a driving motor 55 for a low-speed rotation installed on the bottom face of the rotary table 42, rotating the rollers 53, and a power supply (not shown) supplying power to the driving motor 55. Although it is not shown, the external power supply is supplied by a cable (not shown) passing through the inside of the support column 21.

The rail 51 is formed of a circular loop, along the planar circumference between the shaft passing hole 34 formed in the central portion of the fixed table 22 and the outer wall 35 formed in the outer circumference of the fixed table 22. The rollers 53 are installed with the same interval on the bottom face of the rotary table 42, corresponding to the rail 51. The driving motor 44 is connected to either of the plurality of rollers 53.

With this configuration, if power is supplied to the driving motor 55, the roller 53 slowly rotates to travel along the rail 51. At this time, the other rollers 53 installed on the lower circumferential face of the rotary table 42 freely rotates to travel along the rail 51 installed in the top face of the fixed table 22, to thereby allow the rotary table 42 to be slowly rotated relative to the fixed table 22. Accordingly, the cabin 10 supported by combination with the rotary table 42 of the rotary unit 40 is slowly rotated together with the rotary unit 40.

Under the cabin 10 is buried the water tank 60 within the ground. The water tank 60 is comprised of a water pipe receiver part 61 whose upper end is received in the lower portion of the support column 21 through the passing hole 36 of the support base 23, a storage part 62 disposed beside of the support base 23, storing the water supplied from an external water source, and a communicator part 63 communicating the storage part 62 and the water pipe receiver part 61.

On the top end of the water pipe receiver part 61 is formed the water pipe passing hole 64. To the water pipe passing hole 64 is mounted the extension 65 extended upward along the circumference thereof. The extension 65 is, as described above, enclosed by the bent flange 49 of the rotary shaft 41, thereby preventing foreign materials from being introduced into the water tank 60.

Beside the storage part 62 is provided a water supply part 71 being supplied with water from the external water source. On the top portion of the storage part 62 are provided a manhole 72 opened outward the ground so as to allow the water stored within the water tank 60 to drain off for cleaning the inside of the water tank 60, and a manhole cover 73 covering the opening of the manhole 72.

Preferably, the water supply part 71 is comprised of a water path 75 connecting the storage part 62 to the external water source, a water valve 76 opening and closing the water path 75, a float 77 sensing a level of the water within the water tank 60, and a valve adjuster 78 opening and closing the water valve 76 according to the water level in the water tank 60 sensed by the float 77. If the water within the water tank 60 is under a predetermined level, the water valve 76 is opened for water supply. Conversely, if the water within the water tank 60 is over the predetermined level, the water valve 76 is closed for suspending the water supply.

The communicator part 63 is so formed as to communicate the lower portion of the storage part 62 and the lower portion of the water pipe receiver part 61. With this configuration, the water level of the water pipe receiver part 61 is maintained identically to that of the storage part 62.

The water supply unit 80 is comprised of a water pipe 81 extended down to the water tank 60 through the rotary shaft 41 from the inside of the cabin 10, and a water pump 82 pumping the water within the water tank 60 through the water pipe 81 into the cabin 10, to thereby supply the water stored within the water tank 60 into the cabin 10.

The water pump 82 is installed in the lower part of the sink unit 14 provided within the cabin 10. The water pipe 81 is comprised of a discharge pipe 83 extended toward the sink unit 14, the washstand (not shown) and the toilet 96 from an outlet port of the water pipe 81, and a suction pipe 84 extended toward the water tank 60 from an inlet port of the water pump 82.

The suction pipe 84 passes through the lower plate 11 of the cabin 10, is then bent, to be extended to the pipe passing hole 44 in the central portion of the rotary table 42 through the space formed between the bottom face of the lower plate 11 and the top face of the rotary table 42, is then bent again to be extended downward to the inside of the rotary shaft 41, and is infiltrated in the water of the water pipe receiver part 61 through the water pipe passing hole 64 of the water tank 60. The suction pipe 84 rotates together with the cabin 10 when the cabin is rotated.

To the extended ends of the discharge pipe 83 extended to the sink unit 14 and the washstand (not shown) from the outlet of the water pump 82 are mounted faucets 85 manipulated by the user. If the water pump 82 starts in response to opening of the faucets of the sink unit 14 and the washstand (not shown) or opening of the faucet of the toilet 96, the water stored within the water tank 60 is pumped by the water pump 82 through the suction pipe 84 and is then supplied into the sink unit 14 and the washstand (not shown) or the toilet 96 through the discharge pipe 83.

The draining unit 86 is comprised of a water collector 87 installed in the inner upper portion of the support column 21 of the support unit 20, collecting sewage water therein, and a draining pipe 90 guiding the sewage water from the inside of the cabin 10 into the water collector 87.

The water collector 87 takes a cylindrical shape having an upward opening. In the central portion thereof is formed a rotary shaft passing hole 95 through which the rotary shaft 41 of the rotary unit 40 passes. The rotary shaft passing hole 95 is disposed concentrically between the support column 21 of the support unit 20 and the rotary shaft of the rotary unit 40. The water collector is comprised of a first storage 88 storing therein the sanitary water drained from the toilet 96 and a second storage 89 storing therein the sewage water drained from the sink unit 14 and the washstand (not shown).

The first and second storages 88 and 89 are disposed concentrically within the water collector 87. The first storage 88 is connected with a septic tank 97 for containing the sanitary water, via a sanitary water discharge pipe 93; and the second storage 89 is connected with an external sewerage system, via a sewage water discharge pipe 94. The discharge pipes 93 and 94 are extended downward along the inner wall face of the support column 21 from the storages 88 and 89, pass through the passing holes 36 of the support base 23 and are then extended to the septic tank 97 and the external sewerage system.

The draining pipe 90 is comprised of a sewage water draining pipe 92 guiding the sewage water from the sink unit 14 and the washstand (not shown) provided within the cabin 10 into the second storage 89 of the water collector 87, and a sanitary water draining pipe 91 guiding the sanitary water from the toilet provided within the cabin 10 into the first storage 88 of the water collector 87.

Each of the draining pipes 91 and 92 is extended downward from the sink unit 14, the washstand (not shown) and the toilet 96 respectively so as to allow them to be rotated together with the cabin 10 and the rotary unit 40 when the cabin 10 is rotated. The draining pipes 91 and 92 are mounted so as for their respective lower outlets to be directed toward their respective storages 88 and 89.

The configuration and installation of the draining pipes 91 and 92 will be described in more detail.

The sanitary water draining pipe 91 is extended downward from the toilet 96 provided within the cabin 10 to pass through the lower plate 11 of the cabin 10. The extended sanitary water draining pipe 91 is bent after passing through the lower plate 11 of the cabin 10, and is then extended to the central portion of the rotary table 42 through the space formed between the bottom face of the lower plate 11 and the top face of the rotary table 42. Subsequently, the sanitary water draining pipe 91 is bent so as to be extended toward a upward opening of the first storage 88, and then passes through the rotary table 42. Finally, the sanitary water draining pipe 91 is installed so as to allow its lower outlet to be partially received in the first storage 88. By this installation, the lower outlet of the sanitary water draining pipe 91 is rotated along the upward opening of the first storage 88 when the cabin 10 is rotated, and the sanitary water from the toilet 96 is stored in the first storage 88 through the sanitary water draining pipe 91 being rotated relative to a central axis of the cabin 10 and then discharged out to the external septic tank 97 through the sanitary water discharge pipe 93.

The sewage water draining pipe 91 is extended downward from the toilet 96 provided within the cabin 10 to pass through the lower plate 11 of the cabin 10. The extended sewage water draining pipe 91 is bent after passing through the lower plate 11 of the cabin 10, and is then extended to the central portion of the rotary table 42 through the space formed between the bottom face of the lower plate 11 and the top face of the rotary table 42. Subsequently, the sewage water draining pipe 91 is bent so as to be extended toward a upward opening of the second storage 89, and then passes through the rotary table 42. Finally, the sewage water draining pipe 91 is installed so as to allow its lower outlet to be partially received in the second storage 89. By this installation, the lower outlet of the sewage water draining pipe 91 is rotated along the upward opening of the second storage 89 when the cabin 10 is rotated, and the sewage water from the sink unit 14 and the washstand is stored in the second storage 88 through the sewage water draining pipe 91 being rotated relative to the central axis of the cabin 10 and then discharged out to the external sewerage system through the sewage water discharge pipe 94.

With this configuration, the sanitary and sewage water generated within the cabin 10 can be discharged outside.

The water supply unit 80 for supplying water into the cabin 10 and the draining unit 86 for discharging sanitary and sewage water within the cabin will enable the user to use the rotary cabin conveniently and pleasantly, with no need to use a common kitchenette, a common washroom and a common laboratory, etc. separate from the bungalow, since cooking, washing and easing nature, etc. can be solved within the cabin.

In the present embodiment, the ladder 19 is elevatably mounted to the cabin 10 for coming in and out. However, a fixed ladder may be, instead, installed to the fixed table 22 of the support unit 20.

In the present embodiment, only the support unit 20 is provided, for supporting the cabin 10 and rotatably supporting the rotary shaft 41. However, considering the weight of the cabin 10, a plurality of auxiliary support units may be further provided outside the support unit 20 between the fixed table 22 and the ground. In this case, the cable for the external power supply may be installed to pass through the inside of one of the auxiliary support units.

Further, in the present embodiment, although the sanitary water and the sewage water have been separately treated, they may be treated by combination.

As described above, the rotary bungalow according to the present invention is provided with the water supply unit for supplying water into the cabin and draining unit for discharging sanitary and sewage water out of the cabin, thereby enabling the user to use the rotary cabin conveniently and pleasantly.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A rotary bungalow, comprising:

a cabin forming an inner space therein;

a hollow rotary shaft extended downward from the cabin;

a support unit rotatably supporting the rotary shaft;

a water tank installed under the cabin;

a water pipe extended between the water tank from the cabin through the rotary shaft; and a water pump pumping the water within the water tank through the water pipe to the cabin.

2. The rotary bungalow according to claim 1, wherein the water tank is buried in the ground.

3. The rotary bungalow according to claim 1, wherein the water pump is installed within the cabin, and the water pipe and the water pump are rotated when the cabin is rotated.

4. The rotary bungalow according to claim 1, further comprising:

a draining pipe extended downward from the cabin so as to discharge sanitary and sewage water from the cabin, being rotated along with the cabin; and a water collector provided in the support unit, storing the sanitary and sewage water from the draining pipe.

5. The rotary bungalow according to claim 4, wherein the water collector includes a discharge pipe discharging the stored sanitary and sewage water in the water collector.

6. The rotary bungalow according to claim 5, wherein the water collector is comprised of the first storage and the second storage disposed concentrically so as to store the sanitary water and the sewage water respectively.

* * * * *